United States Patent [19]

Steinke

[11] 4,300,313

[45] Nov. 17, 1981

[54] LIFT-OUT GATE

[75] Inventor: Mark H. Steinke, North Aurora, Ill.

[73] Assignee: Lyon Metal Products, Incorporated, Aurora, Ill.

[21] Appl. No.: 103,221

[22] Filed: Dec. 13, 1979

[51] Int. Cl.[3] ..... E06B 3/32

[52] U.S. Cl. ..... 49/463; 256/24

[58] Field of Search ..... 49/463, 404, 442, 453; 52/581; 256/24, 59, 65, 73, DIG. 2, DIG. 6; 119/20

[56] References Cited

U.S. PATENT DOCUMENTS

| | | | |
|---|---|---|---|
| 305,489 | 9/1884 | Tucker | 49/453 |
| 2,566,433 | 9/1951 | Taurman | 49/442 X |
| 3,698,692 | 10/1972 | Burrows, Jr. | 256/24 X |
| 3,837,119 | 9/1974 | Canneally et al. | 49/404 |
| 4,007,919 | 2/1977 | Totten | 256/59 |
| 4,083,535 | 4/1978 | Britt | 256/24 |

*Primary Examiner*—Kenneth Downey

*Attorney, Agent, or Firm*—Dithmar, Stotland, Stratman & Levy

[57] ABSTRACT

A fence or railing construction includes two vertical spaced-apart railing posts defining a gateway therebetween and each provided with an elongated vertical guide member which projects into the gateway. A gate is provided with vertical end posts in the form of channel members, the slots of which are dimensioned for respectively receiving therein the guide members, the gate being dimensioned so that the guide members can be inserted into the slots of the gate end posts only by vertical sliding movement. The railing posts and gate end posts are channel members of substantially identical transverse cross section. Two different forms of channel member are disclosed.

10 Claims, 8 Drawing Figures

LIFT-OUT GATE

BACKGROUND OF THE INVENTION

The present invention relates to gate constructions for railings, fences or the like.

The invention particularly relates to gate constructions for use in the railings of storage rack assemblies known as deckovers or mezzanines. These storage rack assemblies are typically used in factories, warehouses or the like for providing one or more additional floors or levels of storage space in a high-ceilinged building. The upper deck level or mezzanine is typically provided with a surrounding railing to prevent articles stored thereon from accidentally falling over the side. Access to the mezzanine is provided by a stairway which leads to a gateway in the mezzanine railing which can be closed by the gate construction of the present invention. But it will be appreciated that the present invention has general utility to any type of railing, fence or the like.

Generally, the frames of mezzanine or deckover assemblies comprise a plurality of interconnected posts and beams as well as stiffening and rigidifying members, the posts and beams typically being channel members. The most common types of channel members used are either U-shaped in transverse cross section or are generally rectangular in transverse cross section with one of the side walls having an elongated slot formed therein running the length of the member to form the channel. Typically, channel members having identical or substantially identical transverse cross sections are used for forming the beams, posts, rails and other structural members of the storage rack construction to simplify the assembly and to minimize the number of different parts.

Gates for railings or the like are well known in the art, but typically they are mounted for pivotal or swinging movement between open and closed positions. This type of gate construction necessitates a considerable amount of wasted space to accommodate the swinging movements of the gate, thereby defeating one of the purposes of the deckover or mezzanine construction, i.e., space conservation. Vertically removable fence sections are also known in the art, typical arrangements being illustrated, for example, in the U.S. Pat. Nos. 3,698,692, 4,007,919 and 4,083,535. The former two patents relate to fence sections which are made up of a plurality of stacked rail members which must be individually inserted or removed. The latter patent described above discloses a fence panel which is removable as a unit, but it is quite complex in construction and is not suited for use with the channel-type structural members typically used in deckover or mezzanine constructions.

SUMMARY OF THE INVENTION

The present invention relates to an improved gate construction for use with a railing, and particularly a railing of a storage rack construction such as a deckover or mezzanine. In particular, the present invention relates to a removable gate.

It is a general object of this invention to provide a gate which is vertically removable as a unit for simple and quick opening and closing in a minimum space.

It is another object of this invention to provide a gate of the type set forth which is constructed of the same type of channel members used in the railing construction and is uniquely adapted for cooperation therewith.

Another object of this invention is to provide a gate of the type set forth which includes vertical end posts having vertical slots therein adapted for receiving therein and vertically sliding over guide members at the opposite sides of the gateway.

It is still another object of this invention to provide a gate of the type set forth which is of simple and economical construction.

These and other objects of the invention are attained by providing a removable gate construction for a railing or the like, the gate construction comprising a pair of spaced-apart vertical railing posts having opposing sides defining therebetween a gateway, two vertically-extending elongated guide members respectively mounted on the opposing sides of the railing posts and projecting inwardly of the gateway toward each other, a gate having two vertical end posts respectively carried at the opposite ends thereof and having an overall width slightly less than the distance between the opposing sides of the railing posts and substantially greater than the distance between the inner ends of the guide members, each of the gate end posts having a vertical slot therein dimensioned and arranged to receive therein in vertically-sliding relationship a corresponding one of the guide members for accommodating vertical sliding movement of the gate to and from a gateway closing position.

Further features of the invention pertain to the particular arrangement of the parts of the gate construction whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENTS

Figure 1:
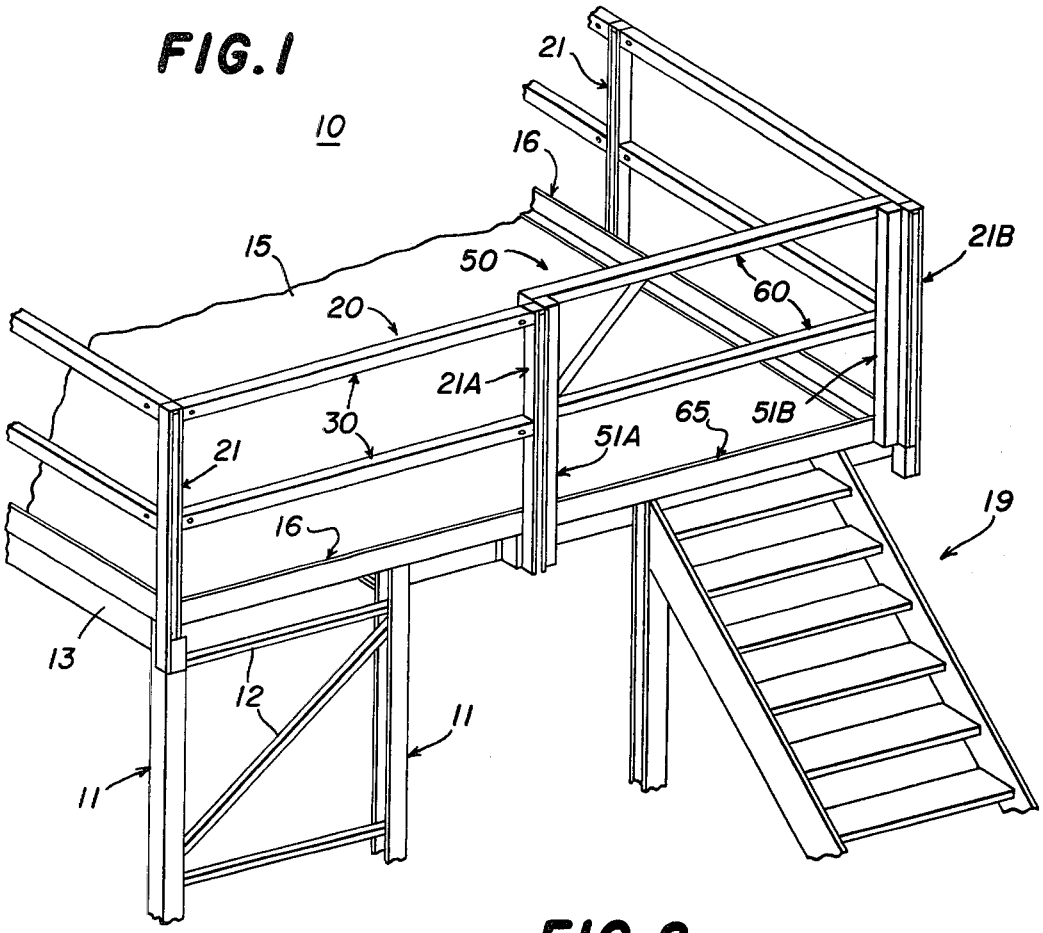
FIG. 1 is a fragmentary perspective view of a deckover or mezzanine including a gate constructed in accordance with and embodying the features of a first embodiment of the present invention.
Figure 2:
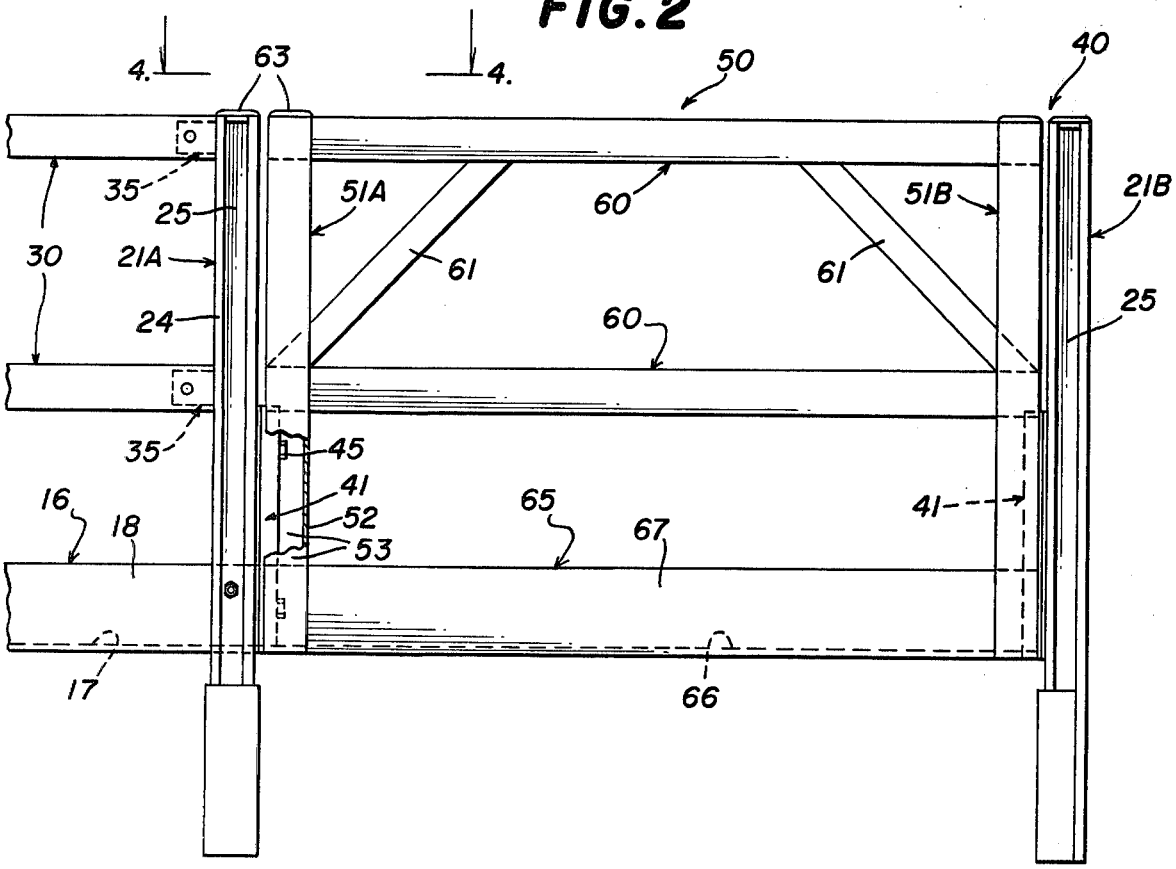
FIG. 2 is an enlarged fragmentary front elevational view of the gate of the mezzanine construction of FIG. 1.

Referring to FIG. 1 of the drawings, there is illustrated a deckover or mezzanine construction, generally designated by the numeral 10, which includes a plurality of upstanding support posts 11 interconnected by sway braces 12 and supporting thereon a plurality of horizontally extending beams 13. Mounted on the beams 13 is a deck or mezzanine 15. Typically, storage racks will be disposed beneath the deck 15 and additional storage space is provided on the deck 15. Preferably, the support posts 11 and beams 13 are formed of channel members of similar transverse cross section. There is also preferably provided a kickplate, generally designated 16, around the perimeter of the deck 15 to provide a curb for preventing small articles on the deck 15 from accidentally being kicked over the edges thereof. The kickplates 16 are right-angle members including a bottom flange 17 and an upstanding side flange 18 (see FIGS. 2 and 4). A stairway 19 provides access to the deck 15.

The deck 15 is provided with a railing assembly, generally designated by the numeral 20, extending around the perimeter thereof, the railing assembly 20 including a plurality of upstanding railing posts 21, interconnected by horizontally extending and vertically spaced-apart rails, generally designated by the numeral 30. Preferably, each of the railing posts 21 and rails 30 comprises a channel member. Two of the railing posts, respectively designated 21A and 21B for ease of description, cooperate to define therebetween a gateway, generally designated by the numeral 40. The railing posts 21A and 21B are substantially identical in construction and therefore only the railing post 21A will be described in detail. It will also be understood that the rails 30 are substantially identical to the railing posts 21 in transverse cross section, differing therefrom only in length.

Referring now also to FIGS. 2 through 6 of the drawings, each of the railing posts 21 is generally rectangular in transverse cross section, including a rectangular rear wall 22, a pair of rectangular opposed side walls 23 and two coplanar front wall portions 24 cooperating to define therebetween an elongated slot 25. It will be understood that the designations of the walls of the railing posts 21 are purely arbitrary. In use, the railing posts 21A and 21B are arranged with the slots 25 thereof facing outwardly of the railing assembly 20 and with one of the side walls 23 of the railing post 21A disposed in parallel facing relationship with one of the side walls 23 of the railing post 21B for cooperation therewith to define the gateway 40 therebetween.

Preferably, the rails 30 are arranged with the slots thereof facing down, and with the side walls thereof provided with rectangular apertures 31 therein adjacent to the ends thereof. The ends of the rails 30 are connected to the railing posts 21 by means of coupling brackets, generally designated by the numeral 35. The coupling bracket 35 is generally U-shaped having a bight portion 36 and a pair of legs 37 respectively provided with aligned circular apertures 34 therethrough. The coupling bracket 35 is dimensioned to be fitted within the open end of a rail 30, with the apertures 34 respectively disposed in alignment with the apertures 31 in the rails 30 for receiving therethrough carriage bolts 38 which cooperate with nuts 39 securely to fasten the coupling bracket 35 within the rail 30.

Figure 3:
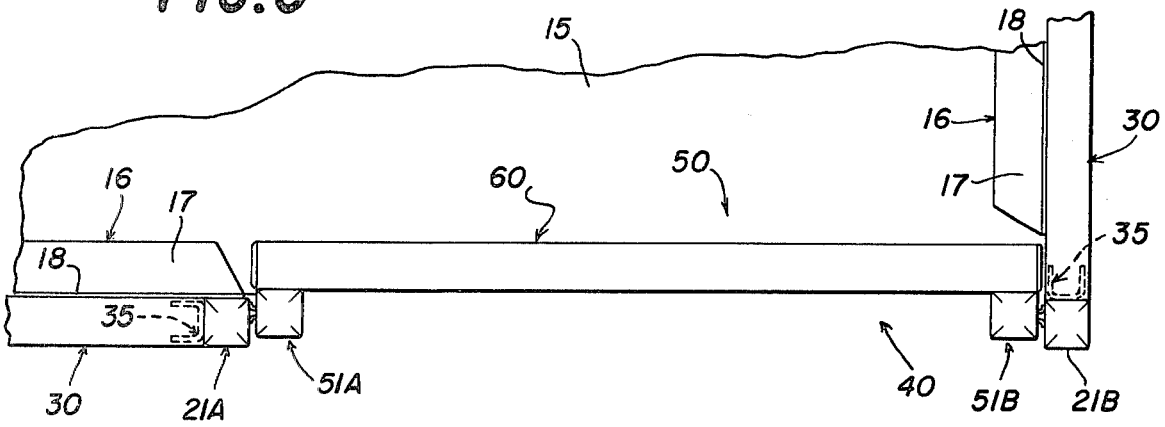
FIG. 3 is a fragmentary top plan view of the gate of FIG. 2.
Figure 4:
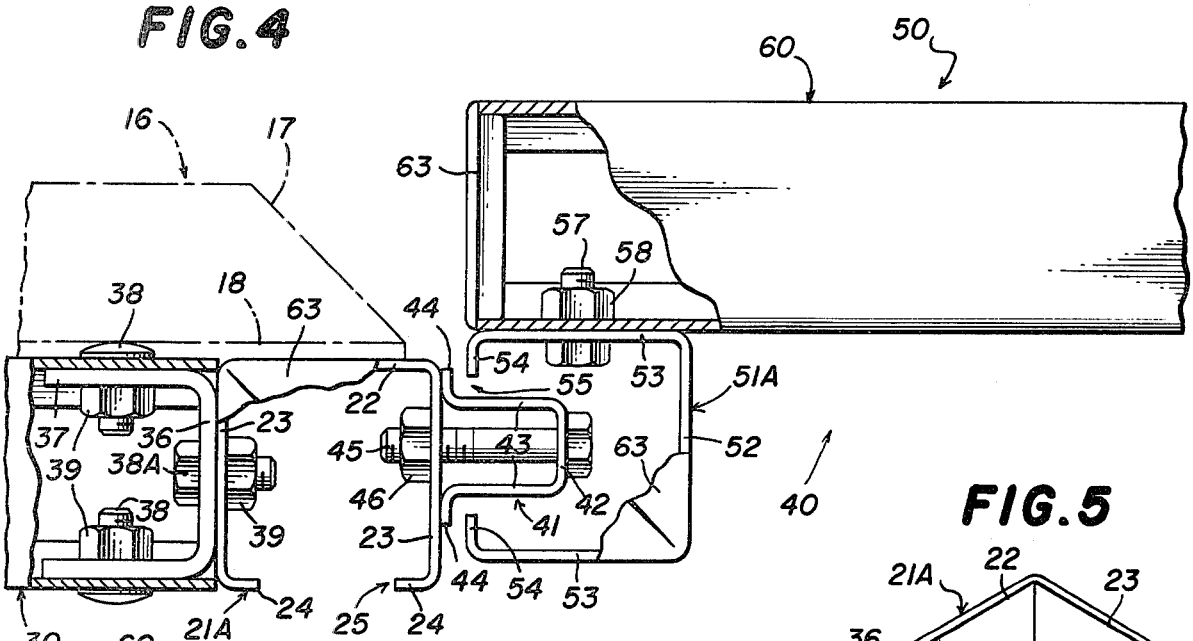
FIG. 4 is a further enlarged fragmentary view taken along the line 4—4 in FIG. 2, with portions of the gate construction broken away more clearly to show the internal construction thereof.
Figure 5:
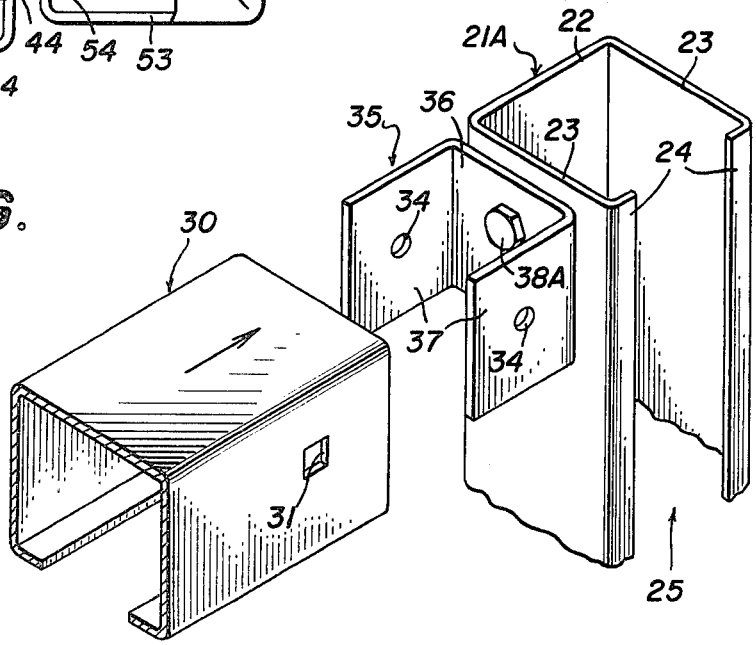
FIG. 5 is an exploded fragmentary perspective view of one of the railing posts which defines the gateway for the gate of FIG. 2.
Figure 6:
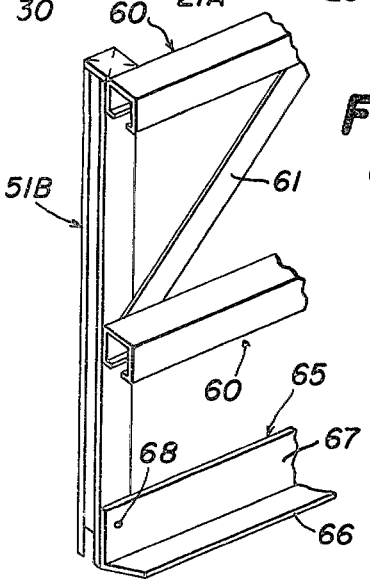
FIG. 6 is a fragmentary perspective view of the right-hand end of the gate of FIG. 2.

Referring in particular to FIGS. 4 and 5, by way of example, the railing post 21A is disposed with its side wall 23 thereof in abutting relationship with the bight portion 36 of the coupling bracket 35, a hex-head bolt 38A being received through complementary openings in the bight portion 36 of the coupling bracket 35 and the side wall 23 of the railing post 21A for cooperation with a nut 39 securely to fasten the railing post 21A to the rail 30. It will be understood that the railing post 21B may be connected to associated rails 30 in the same manner or, as illustrated in FIG. 3, the rails 30 may be connected to the rear wall 22 of the railing post 21B, in which case the railing post 21B forms a corner post of the railing assembly 20.

The inner side wall 23 of each of the railing posts 21A and 21B has mounted thereon a guide member, generally designated by the numeral 41, in the form of an elongated channel member. The guide members 41 are identically constructed, each including a bight portion 42 and a pair of elongated legs 43, each of the legs 43 being provided at the distal end thereof with an outturned support flange 44 disposed in use against the adjacent side wall 23 of the corresponding one of the railing posts 21A and 21B. Each of the guide members 41 is fixedly secured to the associated railing post 21A or 21B by a pair of vertically spaced-apart hex-head bolts 45 extending through complementary openings in the bight portion 42 of the guide member 41 and the adjacent side wall 23 of the railing post for threaded engagement with a nut 46. Preferably, the guide members 41 extend about halfway up the length of the railing posts 21A and 21B from the bottom thereof, the guide members 41 projecting inwardly of the gateway 40 toward each other.

A gate, generally designated by the numeral 50, is provided for closing the gateway 40, the gate 50 including a pair of vertical end posts 51 of substantially identical construction, which have been respectively designated 51A and 51B for ease of description. The gate end posts 51A and 51B are each in the form of a channel member which is substantially identical in transverse cross section to the railing posts 21A and 21B of the railing assembly 20. More particularly, each of the gate end posts 51A and 51B includes a rectangular rear wall 52, a pair of opposed rectangular side walls 53 and two coplanar front wall portions 54 cooperating to define therebetween an elongated slot 55. Preferably, the gate end posts 51A and 51B are arranged with the rear walls 52 thereof disposed facing inwardly toward each other and with the slots 55 facing outwardly.

Interconnecting the gate end posts 51A and 51B at the top thereof and intermediate the upper and lower ends thereof are two horizontally extending and vertically spaced-apart gate rails, each generally designated by the numeral 60, and preferably being in the form of channel members substantially identical in transverse cross section to the gate end posts 51A and 51B, and arranged with the slots thereof facing downwardly. The gate rails 60 may be disposed along the inner side walls 53 of the gate end posts 51A and 51B, as illustrated in FIGS. 3 and 4, and secured thereto by bolts 57 extending through complementary openings and threadedly engaged with nuts 58. Braces 61 may be provided for interconnecting the gate rails 60 and providing a sway bracing for the gate 50. Also, end caps 63 may be provided for the exposed ends of each of the railing posts 21, gate end posts 51 and gate rails 60 to cover the sharp edges thereof so as to prevent snagging or cutting passers by. The end caps 63 may be formed of plastic and are typically designed to be press-fitted into the open end of the associated channel member. A kick-plate, generally designated by the numeral 65, may be provided along the lower edge of the gate 50, the kick-plate 65 including a bottom flange 66 and an upstanding side flange 67 and being fixedly secured to the lower ends of the gate end posts 51A and 51B by suitable bolts 68 and mating nuts (see FIG. 6).

In operation, the gate 50 is dimensioned so that the horizontal distance between the front wall portions 54 of the gate end post 51A and those of the gate end post 51B is slightly less than the width of the gateway 40 as defined by the distance between the railing posts 21A and 21B, but is substantially greater than the distance between the bight portions 42 of the guide members 41. Also, the thickness of the guide members 41 as measured between the outer surfaces of the legs 43 thereof is slightly less than the width of the slots 55 in the gate end posts 51A and 51B. Thus, it will be appreciated that the guide members 41 are respectively receivable in the slots 55 of the gate end posts 51A and 51B but, because of the overall dimensions of the gate 50, the guide members 41 can only be received vertically into the lower ends of the gate end posts 51A and 51B.

Thus, in order to mount the gate 50 in its gateway-closing position illustrated in the drawings, it is lowered into place with the guide members 41 being slidably received upwardly into the slots 55 of the gate end posts 51A and 51B. It will be appreciated that, when the gate 50 has been lowered completely into its gateway-closing position, the guide members 41 cooperate with the gate posts 51A and 51B to prevent any horizontal movement of the gate 50 from its gateway-closing position. This vertical movement of the gate 50 to and from its gateway-closing position requires very little space, and is particularly convenient because the space immediately above the gate 50 is normally not occupied by stored material. When the gate 50 has been removed to provide access to the deck 15 from the stairway 19, it may be placed alongside an adjacent portion of the railing assembly 20, or against material stored on the deck 15.

It can be seen from the foregoing that the gate 50 is of very simple and economical construction and, in particular, is formed of the same type of channel members as is used for the rest of the railing assembly 20 and indeed, for the entire deckover or mezzanine construction 10, thereby greatly facilitating the assembly of the gate 50 and helping to minimize its cost.

Figure 7:
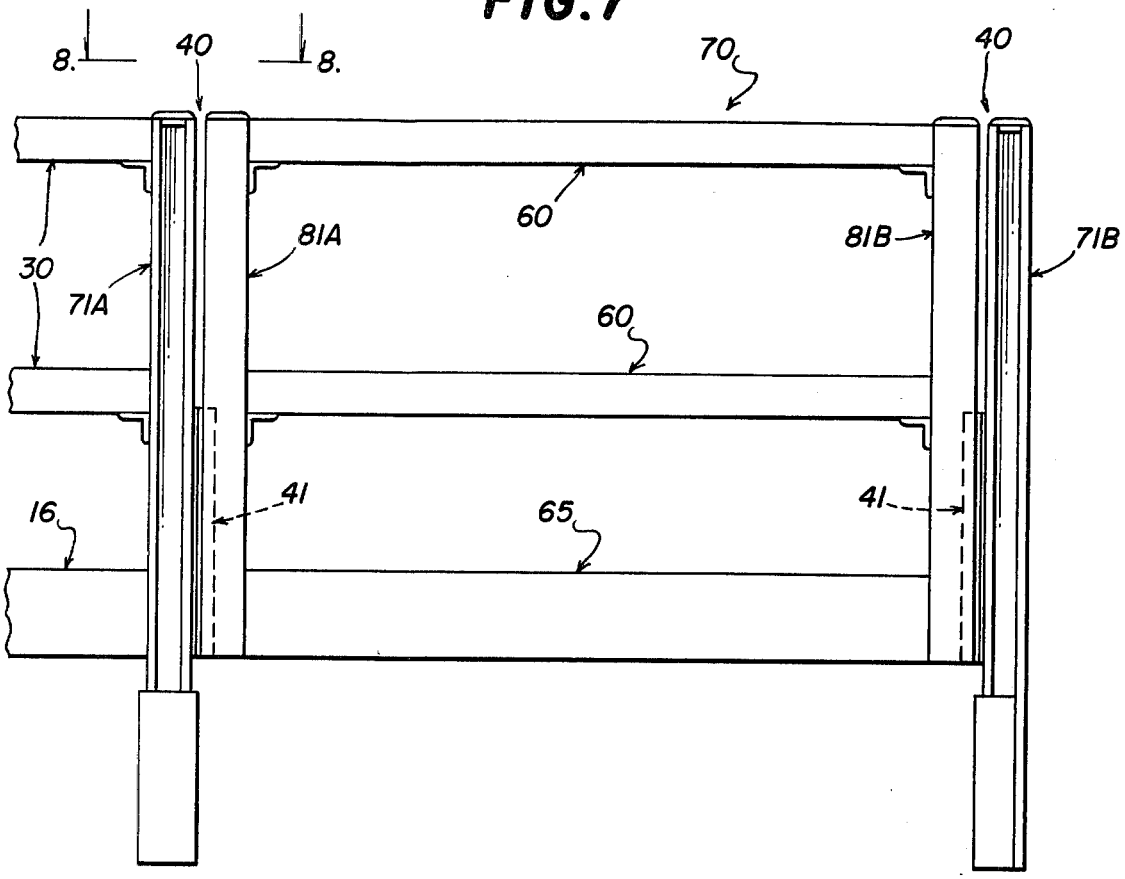
FIG. 7 is a view, like FIG. 2, of a gate constructed in accordance with and embodying the features of a second embodiment of the present invention.
Figure 8:
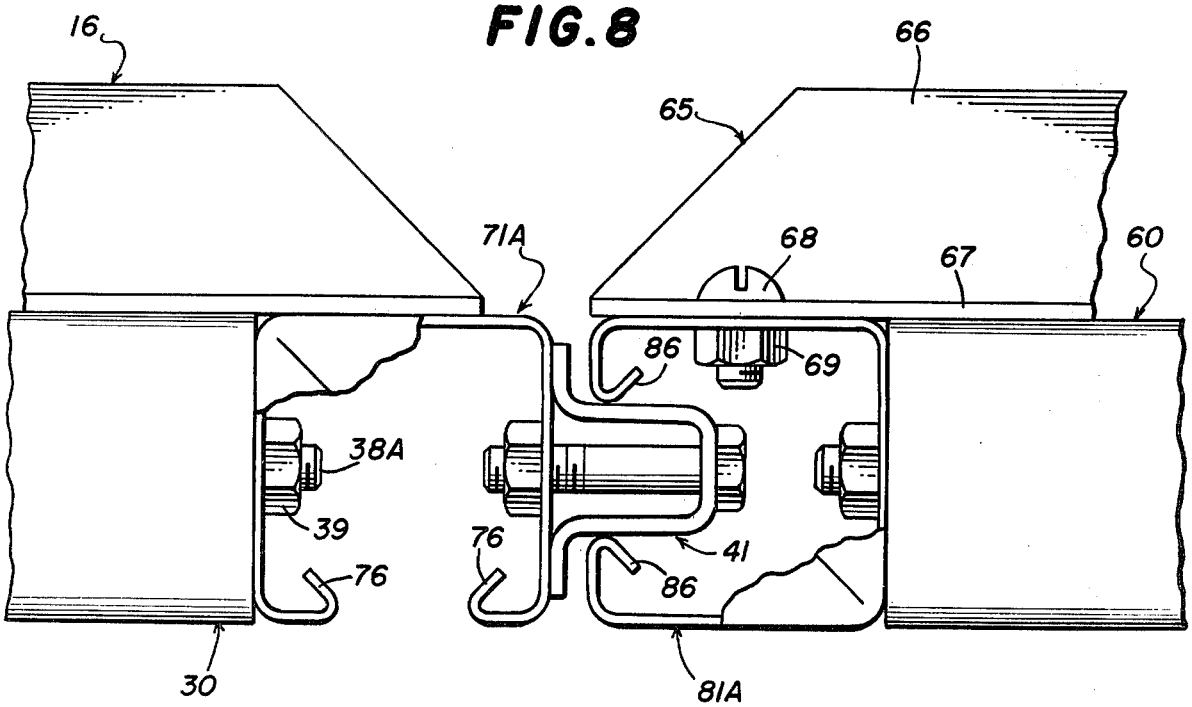
FIG. 8 is an enlarged fragmentary view taken along the line 8—8 in FIG. 7, with portions of the gate construction broken away more clearly to show the internal construction thereof.

Referring now also to FIGS. 7 and 8 of the drawings, there is illustrated an alternative embodiment of gate construction, generally designated by the numeral 70. The gate construction 70 is substantially identical to that illustrated in FIGS. 3 and 4, except that the channel members used to form the railing assembly and gate are of slightly modified construction. More particularly, the railing assembly includes a pair of railing posts 71A and 71B which cooperate to define a gateway 40, these railing posts being substantially identical to the railing posts 21A and 21B described above, with the exception that each of the front wall portions is provided with a flange 76 thereon which extends inwardly of the channel member and away from the slot therein at substantially a fifty-degree angle to the associated front wall portion.

In like manner, the gate construction 70 includes two gate end posts 81A and 81B, which are respectively substantially identical to the gate end posts 51A and 51B described above, with the exception that each of the front wall portions is provided with a flange 86 thereon which extends inwardly of the channel and away from the slot therein at an angle of approximately fifty degrees to the associated front wall portion. This flanged channel construction is designed for use with a form of storage rack construction which utilizes channel members having that identical transverse cross section, the interconnections of such channel members being described in detail in my copending application Ser. No. 028,977, filed Apr. 11, 1979, entitled "Channel Interconnection Apparatus", and assigned to the assignee of the present invention.

In operation, the gate 70 cooperates with the guide members 41 in exactly the same manner as was described above in connection with the embodiment of FIGS. 3 and 4 for moving the gate 70 to and from its gateway-closing position. Additionally, it will be understood that the gate rails 60 may, instead of being connected to the inner side walls of the gate posts, be disposed in alignment with and connected to the facing rear walls thereof, as illustrated in FIG. 8. For this purpose, the interconnection apparatus of the aforementioned application Ser. No. 028,977 is preferably used. It will be appreciated, however, that the coupling brackets 35 and bolts 38 could also be used for interconnecting the rails and posts of both the gate and railing assembly. The smaller thickness or depth of this in-line gate construction would utilize slightly less space than that described in FIGS. 1 through 6 above.

While the gate construction of the present invention has been disclosed as positioned at the top of a stairway leading to the deck of the mezzanine construction, it will be appreciated that such a gate construction could also be used at any other location along the railing assembly 20. Thus, such a gate construction might be used at a location on the mezzanine construction which overlies a wide aisle for lift trucks, so that such trucks might lift a load and transfer it directly to the storage deck after opening of the gate.

From the foregoing, it can be seen that there has been provided an improved gate construction particularly adapted for use with a deckover or mezzanine construction formed of channel members. More particularly, there has been provided a removable gate which is slidably movable vertically to and from a gateway-closing position so as to consume a minimum amount of space, while providing a simple and economical construction uniquely matched with the construction of the rest of the mezzanine and railing assembly thereof.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A removable gate construction for a railing or the like, said gate construction comprising a pair of spaced-apart vertical railing posts having opposing sides defining therebetween a gateway, two vertically-extending elongated guide members respectively adjacent to said opposing sides of said railing posts and projecting inwardly of said gateway toward each other, fastening means removably attaching said guide members respectively to said opposing sides of said railing post, a gate having two vertical end posts respectively carried at the opposite ends thereof and having an overall width slightly less than the distance between said opposing sides of said railing posts and substantially greater than the distance between the inner ends of said guide members, each of said gate end posts being a channel member having two spaced-apart wall portions defining a vertical slot therebetween, said vertical slot having a width slightly greater than the thickness of said guide members, each of said slots receiving therein in vertically-sliding relationship a corresponding one of said guide members for accommodating vertical sliding movement of said gate to and from a gateway-closing position.

2. The gate construction of claim 1, wherein each of said guide members has a vertical extent substantially less than the vertical extent of the corresponding railing post.

3. The gate construction of claim 1, wherein each of said wall portions has a flange thereon extending therefrom inwardly of said wall structure.

4. The gate construction of claim 1, wherein each of said guide members comprises a channel member.

5. The gate construction of claim 1, wherein all of said channel members are substantially identical in transverse cross section.

6. The gate construction of claim 1, wherein said gate includes barrier structure interconnecting said end posts and disposed substantially in alignment therewith.

7. The gate construction of claim 1, wherein said gate includes barrier structure interconnecting said end posts and disposed alongside thereof.

8. A removable gate for use with a railing construction including a pair of spaced-apart vertical railing posts having opposite sides defining therebetween a gateway with two vertically-extending elongated guide members respectively mounted on the opposing sides of the railing posts and projecting inwardly of the gateway toward each other, said gate comprising barrier structure, two vertical end posts carried by said barrier structure at the opposite ends thereof, the horizontal distance between the endmost parts of said end posts being slightly less than the distance between the opposing sides of the railing posts and substantially greater than the distance between the inner ends of the guide members, each of said end posts being a channel member having two spaced-apart wall portions defining a vertical slot therebetween, said vertical slot having a width slightly greater than the thickness of said guide members, each of said slots being arranged to receive therein in vertically-sliding relationship a corresponding one of the guide members for accommodating vertical sliding movement of said gate to and from a gateway-closing position.

9. The gate of claim 8, wherein each of said wall portions has a flange thereon extending therefrom inwardly of said wall structure.

10. A removable gate construction for a railing or the like, said gate construction comprising a pair of spaced-apart vertical railing posts having opposing sides defining therebetween a gateway, two vertically extending elongated channel-shaped guide members respectively located adjacent to opposing sides of said railing post and projecting inwardly of said gateway toward each other, each of said guide members having a vertical extent substantially less than the vertical extent of the corresponding railing post, and fastening means removably attaching said guide members respectively to said opposing sides of said railing post, a gate having two vertical end posts respectively carried at the opposite ends thereof and having an overall width slightly less than the distance between said opposing sides of said railing posts and substantially greater than the distance between the inner ends of said guide members, each of said gate end posts being a channel member having a wall structure substantially rectangular in transverse cross section, each of said channel members having two spaced-apart wall portions defining a vertical slot therebetween and two flanges respectively on said wall portions extending inwardly therefrom, said vertical slot being dimensioned and arranged to receive therein in vertically sliding relationship a corresponding one of said guide members for accommodating vertical sliding movement of said gate to and from a gateway-closing position, said railing post and said gate end post being substantially identical in transverse cross section.

* * * * *